US008863846B2

(12) United States Patent
Overstreet et al.

(10) Patent No.: US 8,863,846 B2
(45) Date of Patent: Oct. 21, 2014

(54) METHOD AND APPARATUS TO PERFORM SUBSEA OR SURFACE JACKING

(75) Inventors: Charles Curtis Overstreet, Katy, TX (US); Scott Michael Cunningham, Houston, TX (US); J. E. Skip Ward, Houston, TX (US)

(73) Assignee: Cudd Pressure Control, Inc., Houston, TX (US)

( * ) Notice: Subject to any disclaimer, the term of this patent is extended or adjusted under 35 U.S.C. 154(b) by 0 days.

(21) Appl. No.: 13/362,810

(22) Filed: Jan. 31, 2012

(65) Prior Publication Data

US 2013/0192842 A1 Aug. 1, 2013

(51) Int. Cl.

| | |
|---|---|
| ***E21B 33/035*** | (2006.01) |
| ***E21B 33/038*** | (2006.01) |
| ***E21B 33/076*** | (2006.01) |
| ***E21B 17/06*** | (2006.01) |
| ***E21B 19/16*** | (2006.01) |
| ***E21B 19/06*** | (2006.01) |

(52) U.S. Cl.

USPC ..... 166/338; 166/340; 166/351; 166/377; 166/77.51; 166/85.1

(58) Field of Classification Search

CPC ..... E21B 23/00; E21B 33/035; E21B 19/00; E21B 19/16; E21B 19/10; E21B 33/043; E21B 33/038; E21B 43/0122; E21B 19/22; E21B 19/06; E21B 19/07; E21B 33/04; E21B 33/047; E21B 41/0007; E21B 17/01; E21B 19/004; E21B 21/00; E21B 34/02; E21B 34/04; E21B 41/0014; E21B 43/013; E21B 43/128; E21B 15/00; E21B 17/05; E21B 17/06; E21B 17/07; E21B 19/002; E21B 19/08; E21B 19/161; E21B 19/165; E21B 19/24; E21B 21/001; E21B 29/12; E21B 33/0355; E21B 33/06; E21B 33/064; E21B 33/085; E21B 34/045; E21B 37/06; E21B 41/0021; E21B 43/01; E21B 43/36; E21B 10/64; E21B 15/003; E21B 17/00; E21B 17/017; E21B 17/02; E21B 17/023; E21B 17/026; E21B 17/028; E21B 17/1007; E21B 17/1085; E21B 19/008; E21B 19/02; E21B 19/086; E21B 19/12; E21B 19/14; E21B 19/155; E21B 19/162; E21B 19/163; E21B 19/166; E21B 2021/006; E21B 21/02; E21B 21/08; E21B 21/106; E21B 23/002; E21B 23/02; E21B 23/04; E21B 23/10; E21B 23/14; E21B 29/00; E21B 29/005; E21B 31/00; E21B 31/16; E21B 33/00; E21B 33/02; E21B 33/0407; E21B 33/05; E21B 33/072; E21B 33/12; E21B 33/122;

(Continued)

(56) References Cited

U.S. PATENT DOCUMENTS 2,166,299 A * 7/1939 Kennedy et al. ..... 175/299
2,188,589 A * 1/1940 Armentrout ..... 166/377

(Continued)

*Primary Examiner* — Matthew Buck
*Assistant Examiner* — Edwin Toledo-Duran
(74) *Attorney, Agent, or Firm* — Winstead PC

(57) ABSTRACT

A jack system may provide subsea or surface operation. The jack system includes a top plate and a base plate with at least two pistons disposed between the base and top plate. The pistons are extendable to increase a separation distance between the base and top plate, and said pistons are retractable to decrease the separation distance between the base and top plate. The jack system also includes a bottom slip bowl assembly, a top slip bowl assembly, and rotary assembly. The top slip bowl and rotary assembly are rotatably coupled to the top plate wherein the rotary assembly and the top slip bowl assembly rotate relative to the top plate.

20 Claims, 3 Drawing Sheets

(52) U.S. Cl.
CPC ..... E21B 33/126; E21B 33/127; E21B 34/00; E21B 34/14; E21B 41/00; E21B 41/02; E21B 41/04; E21B 41/08; E21B 43/0107; E21B 43/10; E21B 43/103; E21B 43/12; E21B 43/123; E21B 43/16; E21B 43/162; E21B 43/166; E21B 43/305; E21B 47/00; E21B 47/0001; E21B 47/011; E21B 47/1221; E21B 47/124; E21B 49/08; E02B 15/107; E02B 15/108; F16B 2/14; F16J 15/406
USPC ..... 166/338, 339, 340, 348, 351, 361, 368, 166/377, 77.51, 77.53, 85.1, 78.1
See application file for complete search history.

(56) References Cited

U.S. PATENT DOCUMENTS

| | | | | | |
|---|---|---|---|---|---|
| 2,912,273 | A * | 11/1959 | Chadderdon et al. | 294/86.34 |
| 2,923,531 | A * | 2/1960 | Bauer et al. | 175/7 |
| 3,180,617 | A * | 4/1965 | Brown | 254/30 |
| 3,421,580 | A * | 1/1969 | Fowler et al. | 166/336 |
| 4,085,796 | A * | 4/1978 | Council | 166/77.53 |
| 4,162,704 | A * | 7/1979 | Gunther | 166/77.53 |
| 4,194,568 | A * | 3/1980 | Buresi et al. | 166/340 |
| 5,139,090 | A * | 8/1992 | Land | 166/369 |
| 5,628,586 | A * | 5/1997 | Arlt, III | 405/195.1 |
| 5,992,516 | A * | 11/1999 | Palynchuk et al. | 166/77.2 |
| 6,009,941 | A * | 1/2000 | Haynes | 166/72 |
| 6,062,312 | A * | 5/2000 | Wilkins | 166/340 |
| 6,142,233 | A * | 11/2000 | Wilkins | 166/339 |
| 6,206,096 | B1 * | 3/2001 | Belik | 166/77.51 |
| 6,209,633 | B1 * | 4/2001 | Haynes | 166/72 |
| 6,213,216 | B1 * | 4/2001 | Rogers | 166/380 |
| 6,347,665 | B2 * | 2/2002 | Rogers | 166/77.51 |
| 6,419,277 | B1 * | 7/2002 | Reynolds | 285/123.1 |
| 6,530,430 | B2 * | 3/2003 | Reynolds | 166/346 |
| 6,536,520 | B1 * | 3/2003 | Snider et al. | 166/78.1 |
| 6,640,939 | B2 * | 11/2003 | Buck | 188/67 |
| 6,688,393 | B2 * | 2/2004 | Sredensek et al. | 166/377 |
| 6,705,405 | B1 * | 3/2004 | Pietras | 166/380 |
| 6,793,019 | B2 * | 9/2004 | Rodgers et al. | 166/344 |
| 6,814,148 | B1 * | 11/2004 | Conner et al. | 166/379 |
| 6,902,199 | B2 * | 6/2005 | Colyer et al. | 285/29 |
| 6,976,298 | B1 * | 12/2005 | Pietras | 29/428 |
| 7,004,259 | B2 * | 2/2006 | Pietras | 166/379 |
| 7,028,787 | B2 * | 4/2006 | Allen et al. | 175/162 |
| 7,090,021 | B2 * | 8/2006 | Pietras | 166/380 |
| 7,117,948 | B2 * | 10/2006 | Mazzella et al. | 166/379 |
| 7,128,161 | B2 * | 10/2006 | Pietras | 166/379 |
| 7,210,525 | B2 * | 5/2007 | Dallas | 166/77.4 |
| 7,213,656 | B2 * | 5/2007 | Pietras | 166/380 |
| 7,284,617 | B2 * | 10/2007 | Pietras | 166/382 |
| 7,311,035 | B2 * | 12/2007 | Reynolds | 92/136 |
| 7,314,087 | B2 * | 1/2008 | Robichaux | 166/355 |
| 7,320,374 | B2 * | 1/2008 | Folk et al. | 175/220 |
| 7,438,126 | B2 * | 10/2008 | Dallas | 166/77.4 |
| 7,451,826 | B2 * | 11/2008 | Pietras | 166/380 |
| 7,578,352 | B2 * | 8/2009 | Hallonquist et al. | 166/383 |
| 7,617,866 | B2 * | 11/2009 | Pietras | 166/77.51 |
| 7,874,352 | B2 * | 1/2011 | Odell et al. | 166/77.51 |
| 7,874,371 | B2 * | 1/2011 | Dallas | 166/383 |
| 7,909,120 | B2 * | 3/2011 | Slack | 175/423 |
| 7,980,310 | B2 * | 7/2011 | Stoesz et al. | 166/301 |
| 8,074,711 | B2 * | 12/2011 | Ellis et al. | 166/77.51 |
| 8,132,626 | B2 * | 3/2012 | Pietras | 166/380 |
| 2001/0000099 | A1 * | 4/2001 | Rogers | 166/77.51 |
| 2002/0134555 | A1 * | 9/2002 | Allen et al. | 166/377 |
| 2003/0066718 | A1 | 4/2003 | Buck | |
| 2003/0155159 | A1 * | 8/2003 | Slack et al. | 175/423 |
| 2004/0256096 | A1 * | 12/2004 | Adams | 166/85.1 |
| 2005/0077039 | A1 * | 4/2005 | Shahin et al. | 166/77.53 |
| 2006/0054331 | A1 * | 3/2006 | Hawkins, III | 166/380 |
| 2006/0118294 | A1 * | 6/2006 | Haakenson | 166/77.52 |
| 2006/0180314 | A1 * | 8/2006 | Williams | 166/355 |
| 2006/0196671 | A1 * | 9/2006 | Robichaux | 166/340 |
| 2008/0053661 | A1 * | 3/2008 | Funk | 166/380 |
| 2008/0078557 | A1 * | 4/2008 | Dallas | 166/381 |
| 2008/0185140 | A1 * | 8/2008 | Pietras | 166/77.51 |
| 2009/0065189 | A1 * | 3/2009 | Hobgood | 166/77.51 |
| 2009/0283322 | A1 * | 11/2009 | Dove | 175/40 |
| 2010/0230092 | A1 * | 9/2010 | Pietras | 166/77.51 |
| 2011/0147010 | A1 * | 6/2011 | Ellis et al. | 166/380 |
| 2011/0214856 | A1 * | 9/2011 | Newman | 166/250.01 |
| 2012/0048535 | A1 * | 3/2012 | Ruttley et al. | 166/85.1 |
| 2012/0211244 | A1 * | 8/2012 | Heidecke et al. | 166/380 |
| 2012/0318522 | A1 * | 12/2012 | Franklin et al. | 166/363 |

* cited by examiner

METHOD AND APPARATUS TO PERFORM SUBSEA OR SURFACE JACKING

FIELD OF THE INVENTION

This invention relates to a jacking system. More particularly, to a method or system for subsea or surface jacking.

BACKGROUND OF INVENTION

In an oil and/or gas well, it may be desirable to run tubulars, pipes, tubing, or the like into the wellbore. A jack is utilized to run or retrieve tubulars into or out of a well. A jack may provide slip bowl assemblies that allow the jack to grip a tubular, and the jack may impart axial force on tubulars to run or retrieve from the well. As the wellbore may be under pressure, the jack may be capable of imparting sufficient axial force to overcome wellbore pressure.

Jacks, such as a casing jack, snubbing jack or hydraulic jack, may be utilized in conjunction with a rig, platform, or vessel. The rig, platform, or vessel may provide various additional tools, such as a top drive, rotary, cutters, tongs, power swivel, clamps, swage, rollers, or the like, utilized in conjunction with the jack to perform various oil and/or gas well operations.

SUMMARY OF THE INVENTION

In one implementation, the jack system includes a top plate and a base plate with at least two pistons disposed between the base and top plate. The pistons are extendable to increase a separation distance between the base and top plate, and said pistons are retractable to decrease the separation distance between the base and top plate. The jack system also includes a bottom slip bowl assembly placed on the base plate, a top slip bowl assembly, and rotary assembly. The top slip bowl and rotary assembly are rotatably coupled to the top plate wherein the rotary assembly and the top slip bowl assembly rotate relative to the top plate. The jack system may be suitable for surface or subsea operations, as well as operations with or without a rig.

In another implementation, a jack system may be utilized in a method for disconnecting a workstring at a desired location. The method includes securing a jack to a wellhead, and securing a workstring with the top slip bowl assembly of the jack; extending the at least two pistons to exert a predetermined amount of tension on the workstring. The method also includes rotating the rotary assembly and the top slip bowl assembly, wherein the rotation of the rotary assembly and the top slip bowl assembly causes the workstring to disconnect at a desired location. Note that the jack system may be suitable for any operations requiring tubulars or the like to be pushed, pulled, and/or rotated. The jack system is in no way limited specifically to use for a method of disconnecting a workstring at a desired location.

The foregoing has outlined rather broadly various features of the present disclosure in order that the detailed description that follows may be better understood. Additional features and advantages of the disclosure will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1A:
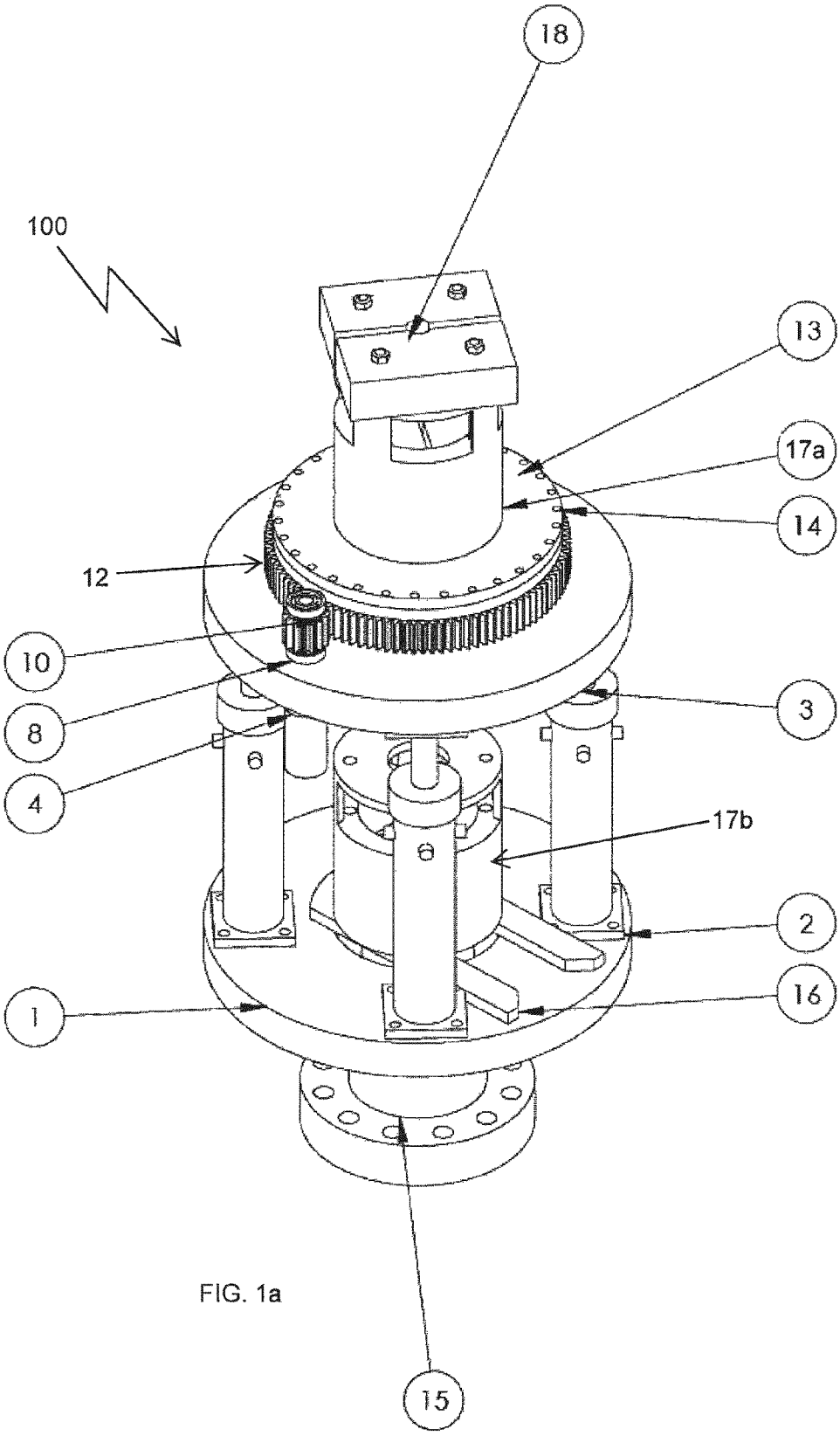
FIG. 1*a*-1*d* are isometric, cross-sectional, front, and side views of an illustrative implementation of a jack system.
Figure 1B:
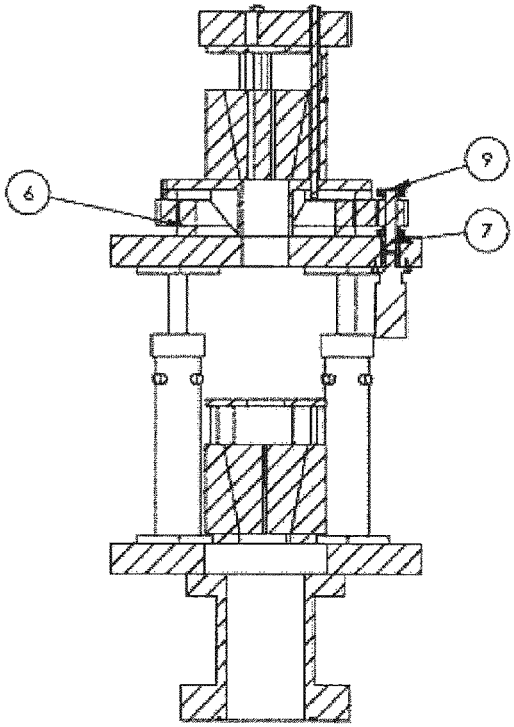
Figure 1C:
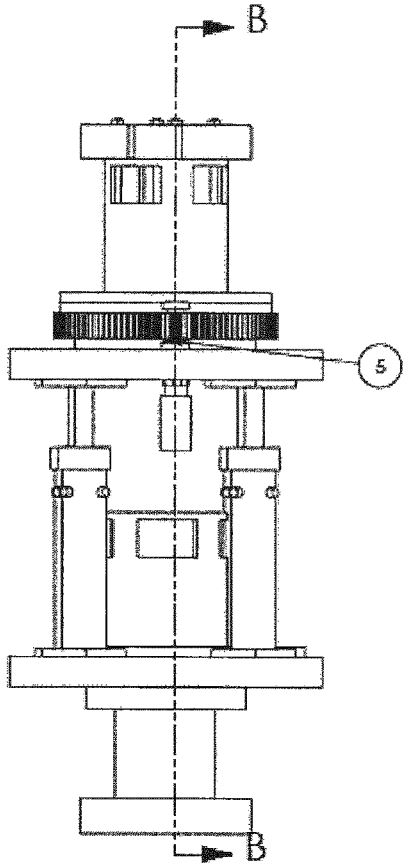
Figure 1D:
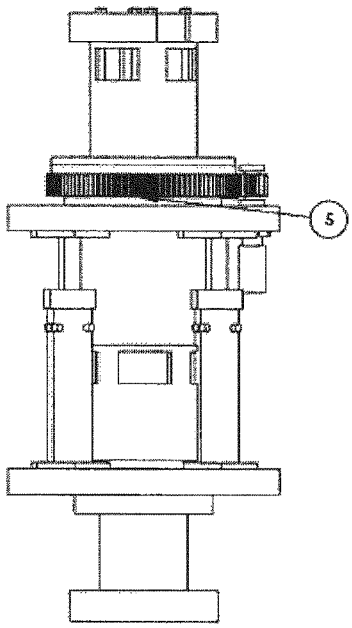

Refer now to the drawings wherein depicted elements are not necessarily shown to scale and wherein like or similar elements are designated by the same reference numeral through the several views.

Referring to the drawings in general, it will be understood that the illustrations are for the purpose of describing particular implementations of the disclosure and are not intended to be limiting thereto. While most of the terms used herein will be recognizable to those of ordinary skill in the art, it should be understood that when not explicitly defined, terms should be interpreted as adopting a meaning presently accepted by those of ordinary skill in the art.

It is to be understood that both the foregoing general description and the following detailed description are exemplary and explanatory only, and are not restrictive of the invention, as claimed. In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise.

A subsea or surface jacking system or method allows one to push, pull, and/or rotate tubulars, pipes, tubing, or the like. The system or method may allow operation with or without the use of a rig, platform, or vessel. The system or method also provides non-vertical or vertical access to a well. For example, an exemplary implementation of the system or method may allow operations such as, but not limited to, blind backoff, tubing recovery, swaging, non-vertical or vertical intervention, tube cutting, subsea or surface operation, and/or the like.

FIGS. 1*a*-1*d* are isometric, cross-sectional, front, and side views of an illustrative implementation of a jack system 100. Jack system 100 provides a bottom plate 1 and a top plate 3 separated by cylinders 2. Cylinders 2 may be hydraulically operated to extend or retract a rod provided within each cylinder 2, thereby allowing cylinders 2 to modify the distance between bottom plate 1 and top plate 3. While the implementation shown provides four cylinders, other implementations may utilize two cylinders or more.

Slip bowl assemblies 17*a*, 17*b* may be actuated to grip or release a tubular, pipe, tubing, or the like. When actuated to gripping position, the slips of a slip bowl assemblies 17*a*, 17*b* secures a tubular. When actuated to a released position, tubulars may move without interference from slip assemblies 17*a*, 17*b*. While the slip bowl assemblies discussed provide a single slip bowl, it will be recognized by one of ordinary skill in the art that the slip bowl assemblies may provide multiple slip bowls for pushing or pulling tubulars. Slip bowl assembly 17*a* coupled to top plate 3 moves up or down with top plate 3 when cylinders 2 are extended or retracted. However, slip bowl assembly 17*b* placed on or secured to bottom plate 1 with slide plate 16 may remain stationary during operation of jack system 100. By engaging a tubular with slip bowl assembly 17*a* and leaving slip bowl assembly 17*b* disengaged from the tubular, the tubular may be run into or retrieved from the wellbore by retracting or extending cylinders 2. Engaging slip bowl assembly 17*b* allows slip bowl assembly 17*a* to be disengaged and cylinders 2 to be extended or retracted without moving the tubular.

In contrast to other jacks, jack system 100 allows for operation either with or without a rig, platform, or vessel. Adapter 15 allows jack system 100 to be coupled to the wellhead. For example, adapter 15 may allow jack system 100 to be connected directly to a wellhead, christmas tree, blow out preventer (BOP), or the like. Additionally, jack system 100 provides a rotary assembly. As a result, in contrast to other jacks, the jack system 100 may be operated without the need for rotary tools provided by a rig, platform, or vessel. These features allow the jack system 100 to be operated subsea and/or without a rig, platform, or vessel. The rotary assembly may provide a motor 4 coupled to gear 10 and gear 12. Motor 4 rotates gear 10, which causes gear 12 to rotate. Gear 12 is coupled to slip bowl assembly 17*a*, which rotates with gear 12. In other implementations, the gears of a rotary assembly may incorporate belt(s) or chain(s) or may be substituted with a belt or chain, worm gear(s), cam(s), ratchet assembly.

When slip bowl assembly 17*a* is actuated to a gripping position and motor 4 is actuated to rotate gears 10, 12, the jack system 100 imparts torque on the tubular, pipe, tubing, or string secured by slip bowl assembly 17*a*. Motor 4 rotates shaft 7, thereby rotating gear 10. One or more bearings 8, spacers 9, or a combination thereof may be provided. Gear 12 may be coupled to slip bowl assembly 17*a* utilizing slip adapter plate 14. Shaft 6 allows gear 12 and slip bowl assembly 17*a* to rotate relative to top plate 3. Additionally, one or more spacer plates 5, 13 may be provided for spacing gear 12 and slip bowl assembly 17*a*. A top portion of slip bowl assembly 17*a* may provide a clamp 18. Clamp 18 may be utilized to secure a tubular and to prevent slippage of the tubular relative to the rotary assembly. For example, in the implementation shown, clamp 18 is a mill clamp. In other implementations, any suitable type of clamp may be utilized, such as a hydraulically actuated clamp. Further, the jack system 100 may optionally provide more than one clamp. While clamp 18 is positioned above slip bowl assembly 17*a*, in other implementations clamp 18 may be relocated or another clamp may be provided in another location. For example, a bar clamp (not shown) may optionally be provided between slip bowl assemblies 17*a*, 17*b* to secure a tubular to prevent rotation or vertical motion, and the bar clamp may be utilized to assist with make up and break out tubulars or the like. While various components of jack system 100 may be hydraulically operated, in other implementations, one or more components of jack system 100 may be electrically operated.

Figure 2B:
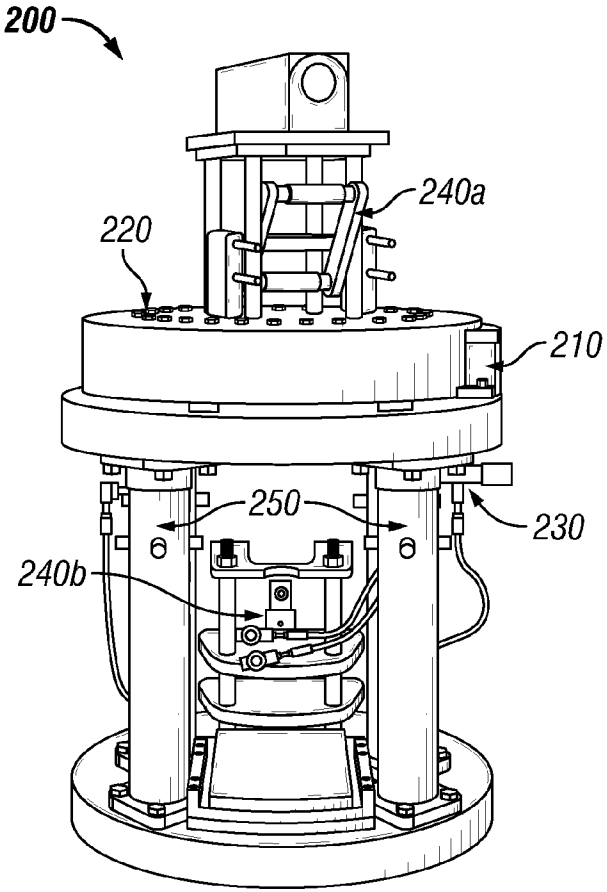
FIG. 2*a*-2*b* are front and side views of an illustrative implementation of a jack system.
Figure 2A:
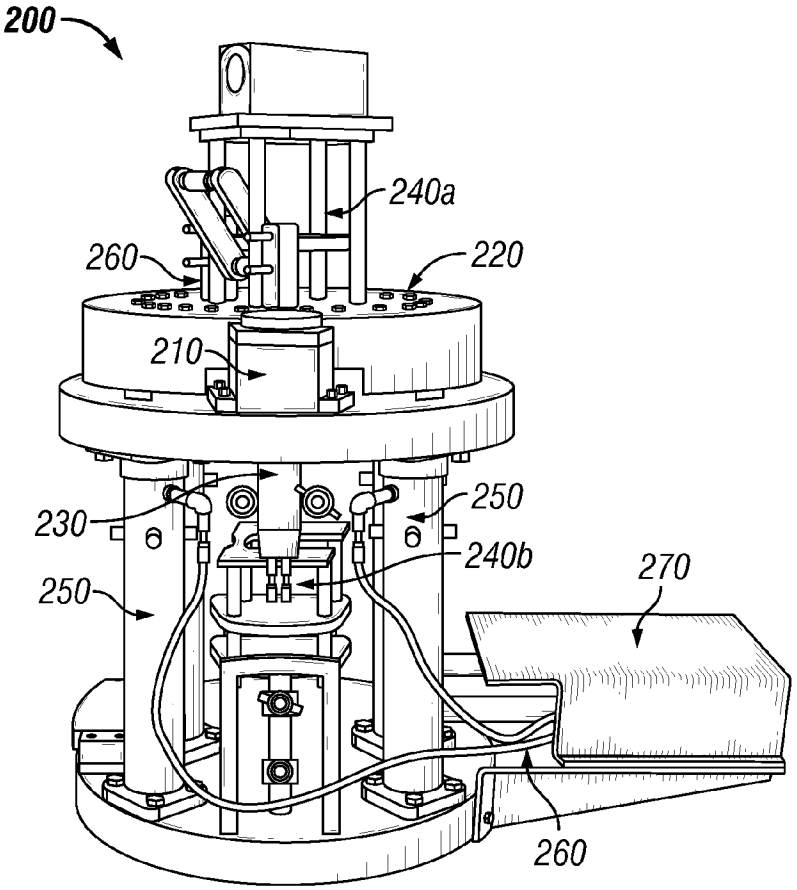

FIGS. 2*a*-2*b* are front and side views of an illustrative implementation of a jack system 200. Gears 210, 220 are covered by protective shields to prevent damage to the gears, damage to other nearby devices (e.g. ROV), and items from getting caught in the gears, such as a divers clothing. Motor 230, slip bowl assemblies 240*a*, 240*b*, and pistons 250 may be hydraulically operated. Hydraulic lines 260 may be connected to motor 230, slip bowl assemblies 240*a*, 240*b*, and pistons 250. Jack system 200 to be coupled to an external device that may be utilized to operate the system, such as a ROV, external power source (electric or hydraulic), hydraulic power pack, hydraulic hose or reel, control panel, or the like. Jack system may be electrically or hydraulically operated.

The aforementioned jacking systems and methods can be utilized to push, pull, and/or rotate tubulars. For example, the jacking systems may be utilized to backoff, make up, or break out tubulars. The jacking systems may be utilized subsea or at the surface with or without a rig, platform, or vessel.

As an exemplary non-limiting usage of a jacking system may be for performing a blind backoff. In certain situations, such as a stuck workstring or tubular, it may be desirable to backoff or unscrew the workstring at a desired joint. Methods for backing off a workstring may utilize explosives and/or may utilize a means for rotating a tubular in combination with a jack or crane. The workstring may be tensioned with the jack or crane to cause changes in the forces on the threaded joints of the workstring. The workstring may be tensioned to ensure forces at a desired backoff joint are minimal relative to the other joints in the workstring, thereby allowing an operator to provide backoff at a desired joint. Further, explosives may also be utilized at the desired joint. Means for rotating a tubular, such as a top drive, rotary table, or power swivel, are provided on a rig, platform, or a vessel, thereby necessitating the need for a rig, platform, or vessel in backoff operations. These means for rotating a tubular are provided separately from the jack and may be significant in size making the device impractical for subsea operation or incorporation into a jack. As a result, backoff is performed from a rig, platform, or vessel. However, due to rough waters, waves, or the like, it may be difficult to accurately exert a desired amount of tension on a workstring. Further, conventional operations on the surface may expose personnel to stored potential energy, which can cause injury to personnel or damage to equipment if failure results.

The aforementioned jacking system overcomes such issues experienced with other jacks. In contrast to other jacks, the jacking system may be coupled directly to the wellhead utilizing an adapter. Since the jacking system is coupled to the wellhead, the jacking system is not subject to vertical forces that may result on a rig, platform, or vessel in rough seas. This allows the jacking system to accurately exert a desired amount of tension on a workstring. The top slip bowl assembly of the jacking system may be closed to secure the workstring, and the pistons may be extended a predetermined amount to exert a desired tension on the workstring. Further, rather that relying on a means for rotating a tubular provided on a rig, platform, or vessel like other jacks, a rotating mechanism is incorporated in the jacking system. Thus, the rotary assembly of the jacking system may rotate the workstring to backoff at a desired joint without the need for rotating means provided on a rig, platform, or vessel. By incorporating a rotating mechanism into the jacking system, the need for rotating tools requiring a rig, platform, or vessel is obviated.

Note that the jacking system is in no way limited specifically to backoff operations. The jacking system is suitable for any operations in which pushing, pull, or rotating tubulars is desired. For example, the jacking system may also be suitable for makeup and break out of tubing joints, makeup and breakout within the wellbore, backing off duals, running and retrieving tubulars, conveying tubing in/out of the wellbore, tripping in/out, fishing operations, etc.

It will be appreciated by one of ordinary skill in the art that various features may be modified in accordance with a desired use. For example, pistons may be selected to accommodate wide range of axial loads. Rotary motor may be selected to accommodate desired torque ranges. The jack system may utilize a single rotary or dualstring/multistring rotary. For example, a dual rotary may be desirable to allow backoff without the need to cut the other tubular out of the way. Pistons may be selected to provide more or less extension. Bottom and top plates may be made thicker or thinner. Bore size of the slip assemblies may be modified to accommodate larger or smaller tubulars. Adapter may be modified to accommodate connection of the jack system to different BOPs, trees, tubulars, casings or the like. Further, different types of clamps, cutter, swage/roller, and/or slip bowl assemblies may be utilized.

Implementations described herein are included to demonstrate particular aspects of the present disclosure. It should be appreciated by those of skill in the art that the implementations described herein merely represent exemplary implementation of the disclosure. Those of ordinary skill in the art should, in light of the present disclosure, appreciate that many changes can be made in the specific implementations described and still obtain a like or similar result without departing from the spirit and scope of the present disclosure. From the foregoing description, one of ordinary skill in the art can easily ascertain the essential characteristics of this disclosure, and without departing from the spirit and scope thereof, can make various changes and modifications to adapt the disclosure to various usages and conditions. The implementations described hereinabove are meant to be illustrative only and should not be taken as limiting of the scope of the disclosure.

What is claimed is:

1. A jack system comprising:

A top plate;

A base plate;

At least two pistons disposed between the base plate and top plate, wherein said at least two pistons are extendable to increase a separation distance between the base plate and top plate, and said at least two pistons are retractable to decrease the separation distance between the base plate and top plate;

A bottom slip bowl assembly positioned on the base plate; and

A top slip bowl assembly and a rotary assembly rotatably coupled to the top plate, wherein the rotary assembly and the top slip bowl assembly rotate relative to the top plate, and the jack system is secured to a subsea wellhead for subsea operations to run and retrieve a workstring in a subsea well and pull or tension a tubular of the workstring, Wherein further the at least two pistons are extended to exert a predetermined amount of tension on the workstring, wherein the predetermined amount of tension corresponds to a desired backoff joint, and exerting the predetermined amount of tension causes forces at the desired backoff joint to be minimal relative to other joints in the workstring, and the rotary assembly and the top slip bowl assembly are rotated while the at least two pistons exert the predetermined amount of tension on the workstring, wherein the rotation of the rotary assembly and the top slip bowl assembly causes the workstring to disconnect at the desired backoff joint.

2. The jack system of claim 1, further comprising an adapter for securing the jack system to the subsea wellhead.

3. The jack system of claim 1, further comprising a clamp for securing the tubular to prevent rotation of the tubular.

4. The jack system of claim 1, further comprising a cutter for cutting the tubular.

5. The system of claim 1, wherein the rotary assembly is a dual rotary to allow for backoff without cutting a second tubular out of the way.

6. The jack system of claim 1, further comprising a hydraulic connector box, wherein the hydraulic connector box provides at least one connector for hydraulically coupling the jack system to an external device.

7. The jack system of claim 6, wherein the external device is a remotely operated vehicle (ROV) that controls operation of the jack system.

8. The jack system of claim 1, wherein the rotary assembly comprises at least one gear.

9. The jack system of claim 8, wherein the rotary assembly further comprises a worm gear.

10. The jack system of claim 1, wherein the rotary assembly is belt driven, chain driven, cam actuated, or ratcheted.

11. A method for disconnecting a workstring at a desired location in subsea operations, the method comprising:

Securing a jack to a wellhead, wherein the wellhead is subsea and said jack is positioned subsea and suitable for subsea operations to run or retrieve a workstring from a well, the jack comprising At least two pistons disposed between a base plate and a top plate, wherein said at least two pistons are extendable to increase a separation distance between the base plate and top plate, and said at least two pistons are retractable to decrease the separation distance between the base plate and top plate, A bottom slip bowl assembly positioned on the base plate, and A top slip bowl assembly and a rotary assembly rotatably coupled to the top plate, wherein the rotary assembly and the top slip bowl assembly rotate relative to the top plate;

Securing the workstring with the top slip bowl assembly of the jack;

Selecting a desired backoff joint in the well, wherein the desired backoff joint specifies a joint of the workstring at which backoff is desired;

Extending the at least two pistons to exert a predetermined amount of tension on the workstring, wherein said predetermined amount of tension corresponds to the desired backoff joint, and exerting the predetermined amount of tension causes forces at the desired backoff joint to be minimal relative to other joints in the workstring; and Rotating the rotary assembly and the top slip bowl assembly while the at least two pistons exert the predetermined amount of tension on the workstring, wherein the rotation of the rotary assembly and the top slip bowl assembly causes the workstring to disconnect at the desired backoff joint.

12. The method of claim 11, further comprising securing the workstring with a clamp to prevent slippage of the workstring.

13. The method of claim 11, wherein the jack provides a cutter for cutting a tubular.

14. The method of claim 11, wherein the rotary assembly is a dual rotary to allow backoff without cutting a second tubular out of the way.

15. The method of claim 11, wherein the jack is hydraulically operated.

16. The method of claim 11, wherein the jack is operated with an electric power source.

17. The method of claim 15, wherein the jack is hydraulically operated by a remotely operated vehicle (ROV) that controls operation of the jack system.

18. A jack system for subsea operations, the jack comprising:

A top slip bowl assembly coupled to a top plate;

A bottom slip bowl assembly positioned on a base plate;

At least two pistons disposed between the base plate and top plate, wherein each of the at least two pistons provides a first end coupled to the top plate and a second end coupled to the base plate;

A rotary assembly rotatably coupled to the top plate, wherein the rotary assembly and the top slip bowl assembly rotate relative to the top plate; and An adapter for securing the jack system to a wellhead, christmas tree, or blow out preventer, wherein said wellhead, christmas tree, or blow out preventer is subsea, and the jack system is suitable for subsea operations to run and retrieve a workstring in a subsea well and pull or tension a tubular of the workstring, Wherein further the at least two pistons are extended to exert a predetermined amount of tension on the workstring, wherein the predetermined amount of tension corresponds to a desired backoff joint, and exerting the predetermined amount of tension causes forces at the desired backoff joint to be minimal relative to other joints in the workstring, and the rotary assembly and the top slip bowl assembly are rotated while the at least two pistons exert the predetermined amount of tension on the workstring, wherein the rotation of the rotary assembly and the top slip bowl assembly causes the workstring to disconnect at the desired backoff joint.

19. The jack system of claim 18, further comprising a hydraulic connector box, wherein the hydraulic connector box provides at least one connector for hydraulically coupling the jack system to an external device.

20. The jack system of claim 19, wherein the external device is a remotely operated vehicle (ROV) that controls operation of the jack system.

* * * * *